US005988538A

United States Patent [19]

Bartels

[11] Patent Number: 5,988,538

[45] Date of Patent: Nov. 23, 1999

[54] REFINER DISC HAVING STEAM EXHAUST CHANNEL

[75] Inventor: Patrick J. Bartels, Sussex, Wis.

[73] Assignee: J&L Fiber Services, Inc., Waukesha, Wis.

[21] Appl. No.: 09/123,532

[22] Filed: Jul. 28, 1998

[51] Int. Cl.[6] ..... B02C 7/12

[52] U.S. Cl. ..... 241/28; 241/244; 241/261.2; 241/298

[58] Field of Search ..... 241/244, 261.2, 241/261.3, 296, 297, 298, 28

[56] References Cited

U.S. PATENT DOCUMENTS

| | | | |
|---|---|---|---|
| 4,005,827 | 2/1977 | Frair et al. . | |
| 4,036,443 | 7/1977 | Saltarelli . | |
| 4,221,631 | 9/1980 | Hellerqvist et al. | 241/244 |
| 4,529,137 | 7/1985 | Matthew et al. . | |
| 4,531,681 | 7/1985 | Matthew et al. . | |
| 4,570,862 | 2/1986 | Kirchner . | |
| 4,586,662 | 5/1986 | Goldenberg et al. . | |
| 4,600,475 | 7/1986 | Reinhall et al. . | |
| 4,614,309 | 9/1986 | Goldenberg . | |
| 4,619,414 | 10/1986 | Kirchner et al. . | |
| 4,620,675 | 11/1986 | Kirchner . | |
| 4,676,440 | 6/1987 | Perkola . | |
| 4,700,900 | 10/1987 | Rowland . | |
| 4,725,336 | 2/1988 | Fisher . | |
| 4,754,935 | 7/1988 | Gullichsen . | |
| 4,953,796 | 9/1990 | Virving . | |
| 5,046,672 | 9/1991 | Demler . | |
| 5,047,118 | 9/1991 | Gullichsen . | |
| 5,076,892 | 12/1991 | Fisher et al. . | |
| 5,165,592 | 11/1992 | Wasikowski . | |
| 5,248,099 | 9/1993 | Lahner et al. . | |
| 5,335,865 | 8/1994 | Kohler et al. . | |
| 5,373,995 | 12/1994 | Johannson . | |
| 5,383,608 | 1/1995 | Dahlqvist et al. . | |
| 5,425,508 | 6/1995 | Chaney . | |
| 5,449,122 | 9/1995 | Berger et al. . | |
| 5,467,931 | 11/1995 | Dodd . | |
| 5,476,228 | 12/1995 | Underberg . | |
| 5,492,548 | 2/1996 | Wasikowski . | |
| 5,690,286 | 11/1997 | Dodd et al. . | |
| 5,823,453 | 10/1998 | Garasimowicz . | |
| 5,824,265 | 10/1998 | Dodd . | |
| 5,863,000 | 1/1999 | Gingras . | |
| 5,868,330 | 2/1999 | Dodd et al. . | |
| 5,875,982 | 3/1999 | Underberg . | |

FOREIGN PATENT DOCUMENTS

| | | | |
|---|---|---|---|
| 2083375 | 3/1982 | United Kingdom | 241/244 |

OTHER PUBLICATIONS

Allison, B.J., A.J. Isaksson, and A. Karlstrom. "Grey box identification of a TMP refiner," proceedings of the *1995 International Mechanical Pulping Conference*, pp. 119–124.

Engstrand, Per, Anders Karlstrom, and Lennart Nilsson. "The Impact of chemical addition on refining parameters," proceedings of *1995 International Mechanical Pulping Conference*, pp. 281–286.

*Primary Examiner*—Mark Rosenbaum
*Attorney, Agent, or Firm*—Nilles & Nilles S.C.

[57] ABSTRACT

A rotary disc refiner includes a pair of spaced apart refiner discs for refining or grinding a material that typically is fibrous material such as wood pulp or the like. Pressurized vapor, typically steam, produced as a result of the refining or grinding is exhausted through a channel in the refiner disc which extends through the body of the disc. Preferably, the channel is located in a refiner disc that rotates. The channel includes a vapor inlet opening located preferably in the high pressure midsection of the refiner disc, a vapor outlet opening which discharges the steam to the relatively low pressure outer section of the disc, and a passageway behind the refining or grinding surface of the refiner disc connecting the inlet to the outlet.

59 Claims, 3 Drawing Sheets

REFINER DISC HAVING STEAM EXHAUST CHANNEL

BACKGROUND OF THE INVENTION

1. Field of the Invention

The present invention relates to a refiner for refining material for use in the production of paper, paper-related products and other products. In particular, the present invention relates to a refiner disc which includes an exhaust channel extending through the body of the disc for venting high pressure steam and/or other vapor during the refining process and a method for relieving pressure buildup between two opposed refiner discs through the use of such an exhaust channel.

2. Discussion of the Related Art

A refiner is a machine that mechanically treats and breaks down wood chips and clumps of fibers into individual pulp fibers from which paper may be made. In a rotary disc refiner, pulp fibers are shredded between closely spaced discs. A refiner disc consists of a round steel or steel alloy plate which has a generally flat grinding surface comprised of a multiplicity of generally radial ribs forming generally radial grooves between them. Typically, a first disc is mounted on a rotor for rotation about an axis, and a second disc is disposed in a position opposing the first disc. Alternatively, the second disc may be mounted on an oppositely rotating rotor so that the two discs rotate about the same axis of rotation but in opposite directions. In either case, the relative motion of the ribs and grooves on the grinding surfaces of the two opposing discs rolls and tears, shears and grinds the bulk fiber material into finely ground pulp fibers.

In refining pulp, friction during the refining process produces a large amount of heat. Of course, pulp fibers have at least some amount of water content, and in some refining operations water or other chemical solutions may be added to the fiber mass during the refining process. Additionally, these fibers typically are transported to and from the refiner in a watery slurry. The temperatures produced during refining, however, are sufficiently high to vaporize the water and therefore a great amount of steam typically is generated during the process.

In analyzing the steam pressure versus the radius of the refining disc, peak steam pressure is typically located approximately at the midpoint of the disc. It is believed that steam pressure is highest in this area of the disc because the number of ribs and grooves is greater at the midsection. In looking at a typical refining disc, the radially interior portion of the disc is comprised of a relatively few widely spaced ribs and grooves for gross break-up of the bulk material. During the process, centrifugal force produced by the rotation of the disc causes the fibers to migrate from the center of the disc to the outer portion of the disc. At approximately the midsection, as well as the outer section of the disc, the number of ribs and grooves is increased, and the spacing between the grooves is much narrower in comparison to the center of the disc. The mid and outer sections of the disc are commonly referred to as the "refining zone" because it is in this area that the fibers are most finely ground. In any event, because the amount of friction is higher in the midsection of the disc, temperatures and steam pressures are also higher. It is also believed that steam pressure is highest at the midsection of the discs because that is the most confined area of the refining zone. The causes of peak steam pressure at the midsection of the refining discs is further explained and illustrated in, for example, B. J. Allison, et al., "Grey-Box Identification of a TMP Refiner," 1995 International Mechanical Pulping Conference, pages 119–24, and Per Engstrand, "The Impact of Chemical Addition on Refining Parameters," 1995 International Mechanical Pulping Conference, pages 281–86.

High steam pressure at the midsection of the refining discs causes a number of operational difficulties. First, high steam pressure generated during the refining process tends to force the discs apart thereby reducing the amount of force the discs actually applies to the fiber lessening their treatment. The force of the steam also causes the disc to oscillate to some degree as it rotates. Of course, larger motors and thrust bearings can be used to compensate for the energy wasted on simply forcing the plates together, but obviously at a higher cost. Second, high pressure steam in the midsection of the refining plate tends to blow some wood pulp out of the refining zone prematurely before it is adequately refined. In some cases the steam forms a back pressure which restricts the movement of wood pulp through the refining zone. Both situations can cause an inconsistency in the refined pulp fibers.

Others have of course sought to address the undesirable effects of high pressure steam generated during refining. For example, U.S. Pat. No. 5,373,995 issued to Ola M. Johannson on Dec. 20, 1994, discloses a refining disc having a number of dams in the grooves, and apertures in the ribs of the disc. The dams in the grooves block the radial movement of the pulp fibers, while the apertures in the ribs provide passages for venting the steam out of the refining zone. While the dams tend to reduce the amount of fibers being prematurely blown out the refining zone, the apertures in the ribs do not necessarily alleviate the very high pressure generated at the midsection of the refining plate. Another example is U.S. Pat. No. 4,676,440 issued to Markku Perkola on Jun. 30, 1997, which discloses a series of deep arc-shaped channels on the face of the disc for exhausting steam. However, because the large channels take up so much of the space on the face of the disc, the amount of surface area for actual refining is greatly reduced. Consequently the overall effectiveness and consistency of the refining is greatly reduced. A second problem with Perkola is that a significant amount of insufficiently refined fibers are drawn into the deep channels and discharged from the refining zone prematurely.

Consequently, a rotary disc refiner for refining wood pulp which includes an effective means for venting steam from a high pressure zone of the refining disc to a low pressure zone, and which will not adversely affect the consistency of the refined fibers is desired.

SUMMARY OF THE INVENTION

A steam or vapor exhaust channel extending through the body of a refiner or grinding disc is disclosed. Specifically, the present invention relates to a steam or vapor exhaust channel comprised of a vapor inlet opening at the midsection of the refining or grinding disc, a vapor outlet opening at the radially outer portion of the disc, and a passageway extending behind the refining or grinding surface and through the body of the disc from the inlet to the outlet. High pressure steam or vapor generated during the refining process is thereby exhausted from the high pressure area at the midsection of the refining disc to the outer portion of the disc where the pressure is relatively lower. The vapor inlet opening is especially designed to inhibit the amount of material being refined that enters the channel. To the extent that a certain amount of material being refined does incidentally enter into the channel, the channel itself and the vapor outlet opening are especially designed to utilize the steam or vapor flow and the centrifugal force of the disc as it rotates during refining to eject the material from the channel and advantageously discharge it back into the refining zone for further processing.

The material that can be refined using a rotary disc refiner having refining or grinding discs of this invention includes without limitation wood chips, cotton, rag, cloth, other fibrous material, and other material which need not be fibrous. Nonfibrous material preferably includes particulate or granular material and the like. The material being refined typically is used in making paper, paper products, other fiber-based products, and products which need not be made of fibrous material. The material being refined can be mixed with water, another liquid, such as a solvent, or a combination of another liquid and water making a liquid slurry that is typically used to transport the material being refined to and from the refiner.

Objects, features and advantages of the invention are therefore to provide a means in a rotary disc refiner for venting steam or vapor from a high pressure zone of the refining disc to a low pressure zone; to provide a steam or vapor channel which extends behind the refining or grinding surface of the disc and through the body of the disc from a vapor inlet to a vapor outlet; to provide a vapor inlet which limits the amount of material being refined that enters the steam channel incidentally; to provide a means for ejecting the material being refined or ground that does incidentally enter the steam channel; to provide a refining or grinding disc that can be used to vent steam where the fibers or material being refined is transported in a water slurry and that can be used to vent vapor and/or steam where the material being refined is transported in a fluid slurry that is not necessarily water-based or not completely water-based; to provide a refining or grinding disc for a rotary disc refiner designed to minimize the negative effects of high pressure steam or vapor generated during the refining process; to provide a refining or grinding disc for a rotary disc refiner designed to maximize the amount of time that the material being refined is treated in the refining zone of a refiner and thereby enhance the consistency of the material after it has been refined; to provide a refining or grinding disc for a rotary disc refiner that prevents excessive buildup of steam or vapor pressure between opposed pairs of refiner or grinding discs thereby increasing the mechanical advantage of the discs in treating the material being refined; and to provide a refining or grinding disc for a rotary disc refiner that minimizes oscillation of the opposed pairs of discs by preventing buildup of steam or vapor pressure between the discs for improving the consistency of treatment applied to the material being refined.

Other objects and advantages of this invention will become apparent from the following description taken in connection with the accompanying drawings which set forth, by way of illustration and example, certain embodiments of this invention.

BRIEF DESCRIPTION OF THE DRAWINGS

The drawings, which constitute part of this specification and include exemplary embodiments of the present invention, include the following.

DETAILED DESCRIPTION OF THE INVENTION

Figure 1:
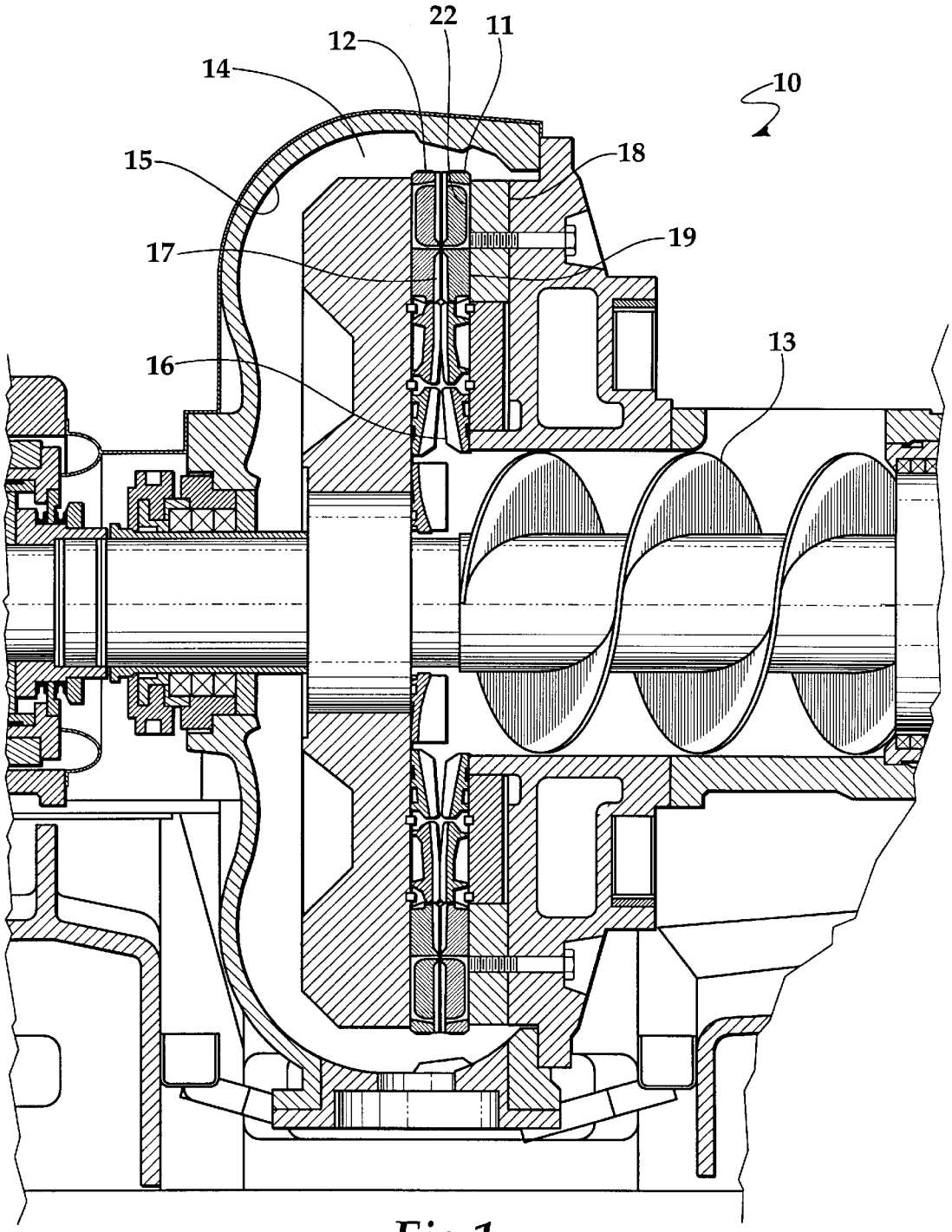
FIG. 1 is a sectional view of a rotary disc refiner and includes a cross-sectional view of a refining or grinding disc of the present invention.
Figure 3:
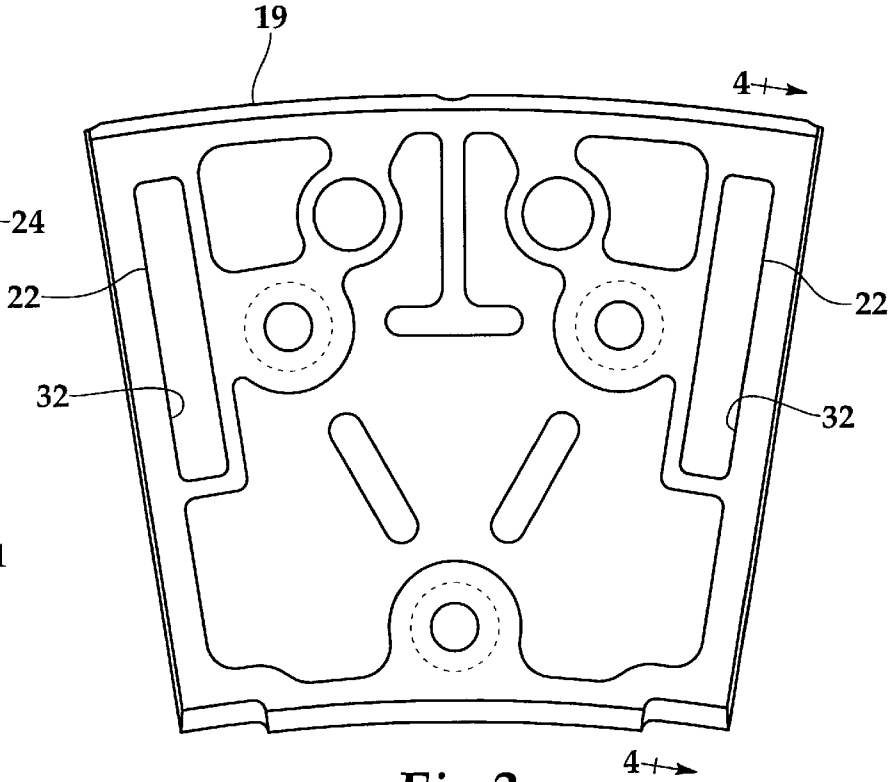
FIG. 3 is a rear view of the segment of the disc shown in FIG. 2.

FIG. 1 illustrates a rotary disc refiner 10 for treating pulp fiber and other types fiber used in making paper products and other types of fiber-based products. Preferably, the rotary disc refiner 10 can also be used for abrading, grinding, conmminuting, orienting, mashing, as well as refining materials that can be non-fibrous materials.

The refiner 10 includes at least two coacting and opposed refining discs 11 and 12 that are preferably generally coaxial. In one preferred embodiment, such as the exemplary refiner embodiment shown in FIG. 1, one disc 11 is rotated and the other disc 12 is fixed. In another preferred embodiment, the two discs are rotated in opposite directions. In a still further preferred embodiment, more than two discs are used that are preferably grouped in opposed pairs.

The two discs 11 and 12 are spaced apart slightly with their grinding surfaces facing each other. Material to be refined usually in the form of a liquid slurry of wood chips, cotton, cloth, or other material which can be non-fibrous is fed into the space between the two discs through the use of an auger 13 or other similar feeding mechanism. The centrifugal force of the rotating disc causes the material being refined to migrate radially outwardly through the refining zone. Upon refining, the material being refined is discharged into an annular space 14 between the discs and exterior housing 15 of the refiner.

Figure 2:
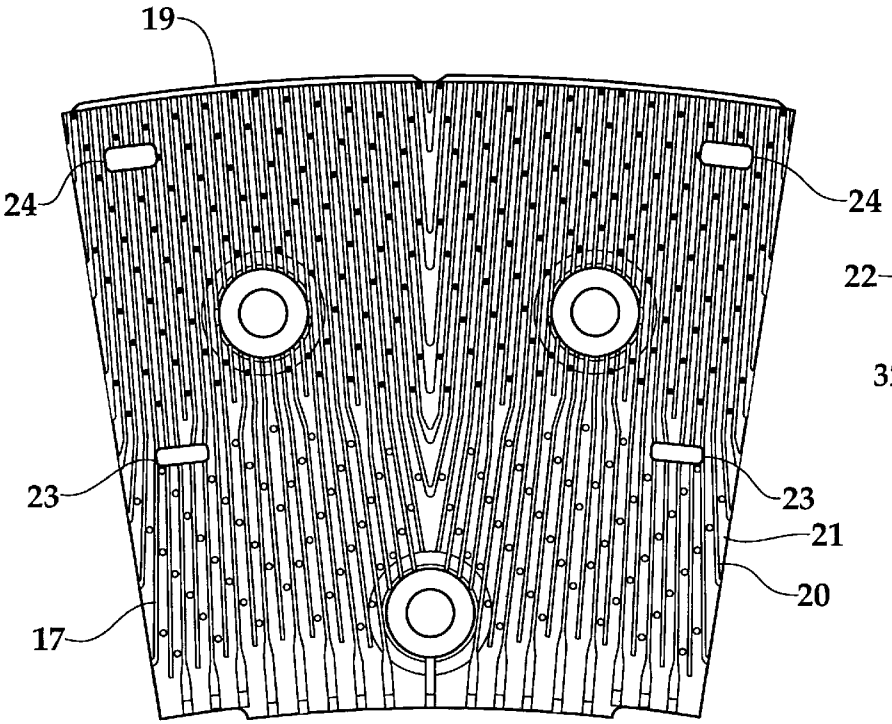
FIG. 2 is a front view of the grinding or refining surface on a segment of the disc.

A refining disc 11 is typically comprised of two sections, a central portion 16 and a refining zone 17. The central portion 16 is the radially inward portion of the disc which initially breaks up wood chips, when used to refine pulp, and other large chunks of material into smaller pieces. The refining zone 17 is the radially outward portion of the disc which shreds the material, when fibrous material, into finely ground fiber. The refining zone is typically comprised of several disc segments mounted on a backer plate 18 arranged preferably in a ring or annulus. FIG. 2 shows one such segment 19.

Referring to FIG. 2, the surface of the disc 11 is comprised of a plurality of generally radial ribs 20 forming generally radial grooves 21 therebetween for successively grinding different sizes of fibers. In looking at the surface of the disc segment 19 shown in FIG. 2, the ribs 20 and grooves 21 are branched and typically increase in number as they extend radially outward. It is in this area that pressure, typically steam pressure, is normally highest, a) due partly because it is the area of an increased number of ribs and grooves which increases the amount of friction applied to the pulp, and b) due partly because the midsection of the disc is the most confined area of the refining zone. Pressure therefore tends to build up in this area.

As mentioned, water contained in the fiber being refined becomes vaporized during the refining process. The present invention is directed to a means for venting such vapor from a higher pressure area of the refining zone to a lower pressure area of the refining zone. The means is comprised of a vapor exhaust channel 22 which extends behind the grinding surface and through the body of the refining disc 11.

Figure 4:
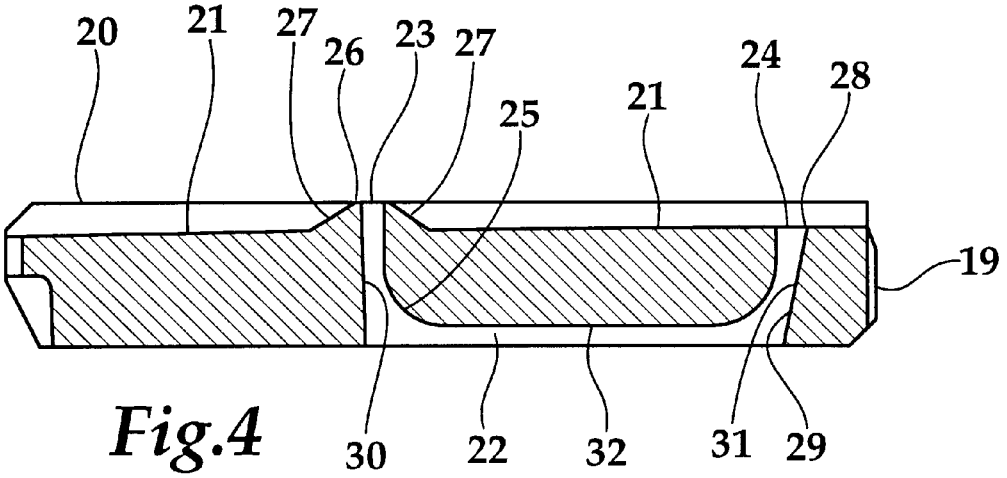
FIG. 4 is a cross-sectional view of the disc shown in FIG. 2.
Figure 5:
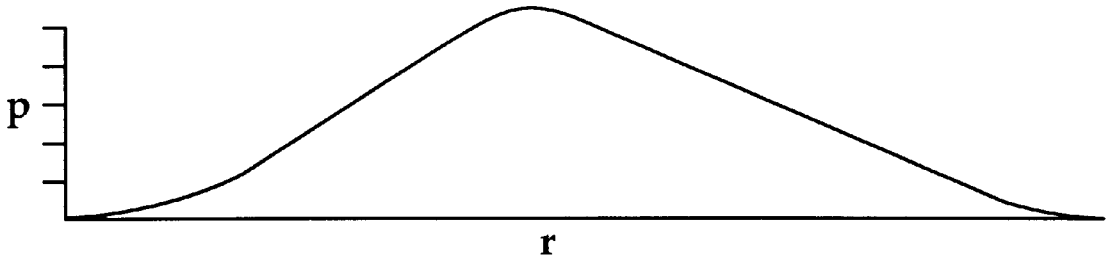
FIG. 5 is a graph of the steam pressure versus the radius of the disc.

Referring to FIGS. 2 and 4, the exhaust channel 22 is comprised of an inlet opening 23 located at approximately the midsection of the refining disc 11 where the pressure is normally quite high, an outlet opening 24 near the radially outward section of the refining disc 11 where the pressure is relatively lower, and a passageway 25 extending behind the grinding or refining surface and through the body of the disc from the inlet 23 to the outlet 24.

The inlet opening 23 is structurally characterized so as to inhibit the amount of material being refined, typically pulp or the like, that might incidentally enter the channel 22. In reference to FIG. 4, the ribs 20 on the grinding surface of the refining disc 11 define an upper edge. The inlet opening is provided with a ridge 26 extending around the periphery of the opening. The upper surface of the ridge 26 around the inlet is substantially coplanar to the upper edge of the ribs 20. Additionally, the surface of the disc immediately adjacent the ridge 26 around the inlet has a small ramp or angled section 27. Consequently, as the material being refined migrates toward the inlet 23, the material is pushed from the bottom of the groove 21 upwardly toward the upper surface of the ridge 26 around the inlet 23. Because the disc 11 is rotating at a high rate of speed, the centrifugal force will cause most of the material being refined to pass over the inlet opening 23. Although not explicitly shown in FIG. 4, the inlet opening may be optionally formed so that the radially outwardly portion of the ridge around the inlet opening is lower than the radially inward portion of the ridge to make it even easier for the material being refined to pass over the inlet opening.

The outlet opening 24 is also structurally characterized so as to enhance the ejection of material being refined that does incidentally enter into the channel 22. Referring again to FIGS. 2 and 4, the grooves 21 define a lower surface of the grinding surface, and the peripheral edge 28 of the outlet opening 24 is substantially coplanar to the lower surface of the grooves 21. Because the outlet opening 24 terminates at the lowest point on the grinding surface of the disc 11, that is, at the bottom of the grooves 21, there is more space for the material being refined to be reintroduced into the refining zone 17. The outlet opening 24 preferably is also slightly wider than the inlet opening 23. Referring to FIG. 4, the radially outward portion of the channel 22 immediately adjacent to the outlet opening 24 includes a surface 29 which is beveled radially outward. Specifically, the outward-most portion of the wall 29 of the channel 22 is slanted slightly outwardly from the back side of the disc toward the grinding surface.

Of course, the refining disc 11 rotates rapidly during operation, typically about 1,200 to 1,800 revolutions per minute. Material being refined is therefore subjected to a significant centrifugal force. The high, narrow inlet opening 23 will naturally limit the amount of material being refined that enters the channel 22 to some degree, but nonetheless it is possible that some amount of material being may enter into the channel. The wide, low beveled outlet opening 24, in combination with the centrifugal force, preferably forces the material being refined through the channel 22 and advantageously discharges it back into the refining zone 17. The outlet opening 24 preferably is located a distance radially inward from the extreme outer edge of the refining disc 11. Therefore, fibrous material that does indeed enter into the channel 22 will still be adequately ground in the extreme outer portions of the refining zone 17. Also, because centrifugal force is needed to move the material being refined through the channel 22 so it will not get jammed, channels 22 of the type described herein are preferably provided only on the rotating discs, and not on the fixed disc, if there is one.

The inlet and outlet openings 23 and 24 represent only about 1% to 5% of the surface area of the disc 11. Therefore, by extending the channel 22 behind the refining or grinding surface and through the body of the disc 11, the negative effects of high pressure are alleviated while a nearly maximum available refining area is maintained. As a result of venting through the channel 22 and passageway 25, pressure buildup between the discs 11 and 12 is alleviated resulting in the spacing between the discs 11 and 12 advantageously remaining relatively constant. A further result of venting pressure buildup, oscillations and the magnitude of oscillations of the discs 11 and 12 are preferably greatly minimized. All of this results in the material being refined being more consistently and better refined. Additionally, by venting the pressure buildup, the residency time of the material being refined in the refining zone further increasing the consistency and quality of refinement.

As mentioned, the refining disc is comprised of a plurality of disc segments 19 which are attached to a backer plate 18. The segments 19 are normally made from metal casting, so the channel 22 is preferably cast into the segment. Referring again to FIG. 4, the channel 22 comprises a radially inward portion 30, a radially outward portion 31, and a central portion therebetween 32. The radially inward portion 30 comprises a tubular section which extends from the inlet opening 23 on the upper surface of the refining disc rearwardly to the back side of the refining disc 11. The radially outward portion 31 likewise comprises a tubular section which extends from the outlet opening 24 rearwardly to the back side of the disc. The central portion 32 comprises a groove which extends across the back side of the disc from the inward portion 30 to the outward portion 31. When the disc segment 19 is assembled to the backer plate 18, the surface of the backer plate 18 forms the rearward wall of the central portion 32 of the steam channel 22.

Depending on the particular operating characteristics of the refiner, the rotating refiner disc preferably contains about 8 to 36 exhaust channels 22 spaced apart about 10° to about 45° around the center of the disc. Additionally, the specific sizes of the inlet and outlet openings, channel dimensions, pitch angle of the beveled surface, and so forth, may be modified for particular applications, pressures, fibrous materials and for other criteria.

The refiner or grinding disc or segment of such a disc having a pressure vent channel 22 and passageway 25 of this invention is well suited for rotary disc refiners of all kinds including without limitation counterrotating refiners, double disc or twin refiners, and conical refiners known in the industry as CD refiners. Additionally, while discs or segments equipped with each channel 22 and passageway 25 of this invention preferably rotate, stationary discs or segments can also be equipped with one or more pressure-buildup relieving channels 22 and passageways 25.

Therefore, the specific structural details disclosed above are not to be interpreted as limiting, but merely as a basis for the claims and for teaching one skilled the art to variously employ the present invention in any appropriately detailed manner. Changes may be made in the details of manufacture, arrangement and operation of the invention without departing from the spirit of the invention, especially as defined in the following claims.

I claim:

1. A rotary disc refiner for grinding a material in a liquid, at least some of which vaporizes as a result of the grinding, the refiner comprising at least two discs having spaced apart opposing surfaces, means for feeding the material into the space between the at least two discs, and means for rotating at least one disc around an axis relative to the other disc, at least one of the discs comprising:

a refining surface comprised of a plurality of generally radial ribs forming generally radial grooves therebetween for grinding said material; and, a channel for exhausting vapor from a first portion of the refining surface of the disc radially outwardly to a second portion of the refining surface, the channel comprising a vapor inlet opening in the first portion of the refining surface of the discs;

a vapor outlet opening in the second portion of the refining surface;

a passageway extending behind the refining surface of the disc from the vapor inlet opening to the vapor outlet opening; and, an upraised ridge disposed adjacent the vapor inlet opening.

2. The rotary disc refiner of claim 1 further comprising a plurality of the vapor exhaust channels spaced apart around the rotating disc.

3. The rotary disc refiner of claim 1, wherein the ribs have an upper surface, and the ridge extends around the periphery of the vapor inlet opening, the ridge having an upper edge which is substantially coplanar to the upper surface of the ribs.

4. The rotary disc refiner of claim 3, wherein the bottom of the grooves defines a lower surface, and the vapor outlet opening has an edge around the periphery of the opening which is substantially coplanar to the lower surface of the grooves.

5. The rotary disc refiner of claim 1, wherein the vapor outlet opening is larger than the vapor inlet opening.

6. The rotary disc refiner of claim 1, wherein the channel has a radially outer portion which includes a radially outwardly beveled wall.

7. The rotary disc refiner of claim 1, wherein the at least one disc comprises a disc segment and a backer plate, the channel being cast into the disc segment, and, when the disc segment is mounted to the backer plate, the backer plate defines a rear wall of the channel.

8. The rotary refiner of claim 7, wherein the at least one disc is comprised of a plurality of disc segments mounted to the backer plate.

9. The rotary refiner of claim 1, wherein said ribs are generally straight and extend radially outwardly from adjacent a radially inner periphery of the at least one disc to adjacent a radially outer periphery of the at least one disc.

10. The rotary disc refiner of claim 1 wherein the first portion of the at least one of the discs is disposed at a radial midsection region of the at least one of the discs and the vapor outlet opening is disposed in the second portion of the refining surface and is located radially outwardly of the vapor inlet opening.

11. The rotary disc refiner of claim 1 wherein the ridge is disposed radially inwardly of the vapor inlet opening and the vapor outlet is disposed radially outwardly of the vapor inlet opening.

12. The rotary disc refiner of claim 11 wherein the vapor inlet opening is disposed in a refining zone of the at least one of the discs.

13. The rotary disc refiner of claim 12 wherein the vapor outlet opening is disposed in the refining zone.

14. The rotary disc refiner of claim 11 wherein the ridge has a generally triangular cross section.

15. The rotary disc refiner of claim 11 wherein at least a portion of the ridge is disposed in one of the grooves.

16. The rotary disc refiner of claim 15 further comprising a second upraised ridge disposed radially outwardly of the vapor inlet opening.

17. The rotary disc refiner of claim 15 wherein the ridge bounds the periphery of the vapor inlet opening.

18. A refiner for refining a fibrous material, the refiner comprising:

at least one pair of spaced apart refining discs, each disc having a refining surface defined by a plurality of generally radial ribs forming generally radial grooves, and at least one disc being rotatable about an axis relative to the other disc for grinding the fibrous material in the space between the discs;

at least one of the discs defining a body and having a steam channel therein, the channel being comprised of an inlet on the refining surface of the disc and an outlet on the refining surface of the disc, and a passageway extending behind the refining surface and through the body of the at least one of the discs from the inlet to the outlet;

wherein steam produced between the pair of spaced apart refining discs as a result of the grinding of the fibrous material by the pair of spaced apart refining discs is exhausted through the passageway from a first portion to a second portion of the refining surface of the at least one of the discs.

19. The refiner of claim 18, wherein the inlet is disposed in a midsection of the disc.

20. The refiner of claim 19, wherein the outlet is disposed in a portion of the disc located radially outwardly of the midsection of the disc.

21. The refiner of claim 18, wherein the rotatable disc is comprised of a plurality of disc segments attached to a backer plate.

22. The refiner of claim 21 wherein at least one of the disc segments has a pair of the steam channels with one of the steam channels circumferentially spaced apart from another of the steam channels.

23. The refiner of claim 21, wherein each disc segment contains at least one steam channel.

24. The refiner of claim 23, wherein the steam channel includes a radially inward portion, a radially outward portion, and a central portion therebetween;

the radially inward portion comprises a first tubular section which extends from the inlet in the refining surface of the disc rearwardly to a back side of the disc;

the radially outward portion comprises a second tubular section which extends from the outlet in the refining surface of the disc rearwardly to the back side of the disc;

the central portion comprises a groove extending across the back side of the disc from the first tubular section to the second tubular section; and, when attached to the backer plate, a surface of the backer plate forms a rearward wall of the central portion of the steam channel.

25. The refiner of claim 18 wherein the first portion is a first region between the pair of spaced apart refining discs having steam at a pressure and the second portion is a second region between the pair of spaced apart discs having steam at a lower pressure than the pressure of the steam in the first region.

26. The refiner of claim 25 further comprising an upraised ridge disposed adjacent to and radially inwardly of the inlet.

27. The refiner of claim 26 wherein the inlet is disposed radially inwardly of the outlet.

28. A refiner comprising:

a first disc rotatable about an axis;

a second disc spaced apart from and opposing the first disc;

each disc having a refining surface comprised of a multiplicity of generally radial ribs forming generally radial grooves for grinding a fibrous material between the discs;

a steam channel in at least one of the discs for venting vapors produced as a result of the grinding from a high pressure area of the refining surface to a lower pressure area of the refining surface, a passageway of the steam channel extending behind and spaced axially from the refining surface of the at least one of the discs; and wherein the steam channel is comprised of a) an inlet opening 1) that is disposed in a midsection of the refining surface of the at least one of the discs and 2) that connects to the passageway, and b) an outlet opening 1) that is disposed in a section of the refining surface located radially outward of the inlet opening and 2) that connects to the passageway.

29. The refiner of claim 28, wherein the inlet opening includes a ridge around the periphery of the opening, and the ridge which extends up to the ribs on the refining surface.

30. The refiner of claim 28, wherein the outlet opening terminates at the bottom of the grooves in the refining surface.

31. The refiner of claim 30, wherein a radially outward portion of the steam channel is beveled outwardly toward the outlet opening.

32. The refiner of claim 28, wherein the outlet opening is larger than the inlet opening.

33. The refiner of claim 28 further comprising an upraised ridge disposed adjacent to and radially inwardly of the inlet opening.

34. The refiner of claim 28 wherein the steam channel has only one inlet opening and only one outlet opening.

35. The refiner of claim 34 wherein the at least one of the discs is comprised of a plurality of pairs of segments and at least one of the segments has a pair of the steam channels with each one of the steam channels extending radially, and one of the steam channels spaced circumferentially from the other of the steam channels.

36. The refiner of claim 28 wherein the at least one of the discs comprises between eight and thirty-six of the steam channels.

37. The refiner of claim 36 wherein adjacent pairs of the steam channels are spaced apart between 10° and 45° relative to a center of the at least one of the discs.

38. The refiner of claim 28 wherein the refiner comprises one of a counterrotating refiner, double disc refiner, or a conical refiner.

39. The refiner of claim 28 wherein the inlet opening has an area and the outlet opening has an area and the combined area of the inlet opening and of the outlet opening is no greater than five percent of the surface area of the at least one of the discs.

40. A refiner disc for a rotary disc refiner comprising:

a) a body having a refining surface comprising a refining zone; and b) a channel for venting pressure buildup adjacent said refining surface comprising an inlet opening in said refining surface, an outlet opening in said refining surface that is disposed outwardly of said inlet opening, and a passageway in said body underlying said refining surface, said passageway connecting said inlet opening to said outlet opening.

41. The refiner of claim 40 wherein said refining surface comprises a central portion disposed radially inwardly of said refining zone.

42. The refiner of claim 41 wherein said inlet opening and said outlet opening are located in said refining zone.

43. The refiner of claim 42 wherein said refining zone comprises a plurality of pairs of spaced apart and straight bars that are upraised from said refining surface and which extend radially outwardly.

44. The refiner of claim 40 further comprising a ridge upraised from said refining surface that is located 1) adjacent said inlet opening and 2) radially inwardly of said inlet opening.

45. The refiner of claim 44 wherein a portion of said passageway is formed in said rear surface of said refining disc.

46. The refiner of claim 44 wherein said upraised ridge bounds the periphery of said inlet opening.

47. The refiner of claim 44 wherein said ridge has an inclined portion that increases in upraised height from radially inwardly of said inlet opening to adjacent said inlet opening.

48. The refiner of claim 40 wherein said outlet opening is larger than said inlet opening.

49. The refiner of claim 40 wherein 1) said refining disc further comprises a rear surface opposite said refining surface and 2) said channel comprises a wall adjacent said outlet opening and defining a portion of said outlet opening wherein said wall is beveled at an angle from said rear surface radially outward toward said refining surface.

50. A refiner disc segment of a refiner disc for a rotary disc refiner comprising:

a) a body having a refining surface comprising a radially outwardly refining zone;

b) a channel for venting pressure buildup adjacent said refining zone comprising an inlet opening in said refining zone, an outlet opening in said refining zone that is disposed radially outwardly of said inlet opening, and a passageway in said body connecting said inlet opening to said outlet opening permitting vapor to flow from said inlet opening through said passageway and out said outlet opening;

c) a ridge upraised from said refining surface with said ridge located 1) adjacent said inlet opening and 2) radially inwardly of said inlet opening; and d) wherein said passageway is defined in part by a generally axially extending radially outward wall adjacent said outlet opening that is beveled radially outwardly.

51. The refiner of claim 50 wherein said outlet opening is larger than said inlet opening.

52. The refiner of claim 51 wherein said passageway extends radially outward from said inlet opening to said outlet opening.

53. A method of refining with a rotary disc refiner comprising:

a) providing a first annular refiner disc having a refining surface, an inlet opening in the refining surface, an outlet opening in the refining surface located outwardly of the inlet opening, a passageway in the first refiner disc that underlies the refining surface and connects the inlet opening to the outlet opening permitting vapor under pressure to travel through the passageway, and a second annular refiner disc having a refining surface that opposes the refining surface of the first refiner disc;

b) rotating one of the refiner discs relative to the other of the refiner discs;

c) introducing a fibrous material in a liquid slurry to be refined between the first and second refiner discs such that the fibrous material to be refined moves radially outwardly from adjacent a radially inward portion of the first and second refiner discs toward a radially outward portion of the first and second refiner discs;

d) venting vapor from a first location between the first refiner disc and the second refiner disc through the passageway;

e) exhausting the vapor between the first refiner disc and the second refiner disc at a second location disposed outwardly of the first location.

54. The method of claim 53 wherein the refining surface of the first refiner disc and the refining surface of the second refiner disc each have a radially outward refining zone and during step d) the vapor is vented through the disc around a portion of the refining zone of both the first refiner disc and the second refiner disc.

55. The method of claim 53 wherein one of the refiner discs is rotated relative to the other of the refiner discs during step b) at between 1200 and 1800 revolutions per minute and in steps d) and e) the vapor has a higher pressure at the first location than at the second location such that the vapor is vented from a region of higher pressure to a region of lower pressure.

56. A refiner for refining a fibrous stock slurry comprising:

a housing having a stock inlet;

a pair of opposed refiner disc mounting surfaces disposed inside said housing with one of said refiner disc mounting surfaces rotatable relative to the other one of said refiner disc mounting surfaces about an axis of rotation;

a first refiner disc removably carried by one of said mounting surfaces, said first refiner disc comprised of a plurality of pairs of refiner segments that each have a refining surface that includes a plurality of pairs of upraised bars with at least a plurality of grooves therebetween;

a second refiner disc removably carried by another one of said mounting surfaces and opposing said first refiner disc, said second refiner disc comprised of plurality of pairs of refiner segments that each have a refining surface that includes of a plurality of pairs of upraised bars with at least a plurality of grooves therebetween; and at least one vapor vent in at least one of said refiner disc segments that includes a vapor inlet that accepts vapor, a vapor outlet in said refining surface that exhausts vented vapor into a gap between said first refiner disc and said second refiner disc, and a vapor passageway in said at least one of said refiner disc segments that interconnects said vapor inlet and said vapor outlet with at least a portion of said vapor passageway underlying said refining surface, said vapor passageway transporting vapor from said vapor inlet to said vapor outlet.

57. The refiner of claim 56 further comprising a ridge upraised from said at least one of said disc segments with said upraised ridge being disposed adjacent to and radially inwardly of said vapor inlet.

58. The refiner of claim 57 wherein said vapor outlet opens into at least one of said grooves of said at least one of said refiner disc segments.

59. The refiner of claim 58 wherein said vapor passageway has a radially outwardly beveled surface that extends generally axially and which is disposed adjacent said vapor outlet.

* * * * *